United States Patent [19]

Wolske

[11] Patent Number: 4,761,079

[45] Date of Patent: Aug. 2, 1988

[54] RECLOSABLE BAG

[75] Inventor: Eugene H. Wolske, Minnetonka, Minn.

[73] Assignee: Bemis Company, Inc., Minneapolis, Minn.

[21] Appl. No.: 108,939

[22] Filed: Oct. 13, 1987

[51] Int. Cl.[4] ..... B65D 33/30

[52] U.S. Cl. ..... 383/62; 383/91; 383/905

[58] Field of Search ..... 383/91, 71, 905, 62

[56] References Cited

U.S. PATENT DOCUMENTS

| | | | |
|---|---|---|---|
| 658,147 | 9/1900 | Herriott | 383/905 |
| 1,979,157 | 10/1934 | Higginbottom | 383/905 |
| 2,071,745 | 2/1937 | Higginbottom | 383/91 |
| 2,356,110 | 8/1944 | Waters | 383/905 |
| 2,415,139 | 2/1947 | Kohl | 383/905 |
| 2,855,137 | 10/1958 | Simonsen | 383/91 |
| 3,290,854 | 12/1966 | MacMurray | 383/71 |
| 3,519,196 | 7/1970 | Paxton | 383/62 |
| 3,784,087 | 1/1974 | Styers | 383/91 |

*Primary Examiner*—Stephen P. Garbe

*Attorney, Agent, or Firm*—Senniger, Powers, Leavitt and Roedel

[57] ABSTRACT

A bag having front and back walls and a bendable metal reclosure therefor having a total length greater than the width of the bag bent at two points spaced a distance corresponding to the bag width to have two tab portions at the ends of an intermediate portion, the latter being secured to one of the walls adjacent an end of the bag extending across that wall generally from one side edge of the wall to the other, the tab portions being bent back on the outside of the intermediate portion, and a cover strip overlying the reclosure.

11 Claims, 4 Drawing Sheets

RECLOSABLE BAG

BACKGROUND OF THE INVENTION

This invention relates to reclosable bags, and more particularly to bags with a bendable metal reclosing strip means of the type referred to in the art as a "tin tie".

Reference may be made to such as U.S. Pat. Nos. 2,855,137, 3,315,877, 3,321,126, 3,545,668, 3,688,973, 3,784,087, 3,865,304 and 4,610,358 for disclosures of reclosable bags of this general type.

The invention is especially directed to bags with bendable metal reclosing strip means (a "tin tie") of the type extending across the outside of one of the walls of the bag adjacent the end of the bag to be reclosed, the strip means having end portions which, after folding over of the end of the bag, may be bent from a position extending outwardly beyond the side edges of the bag around the side edges of the bag to maintain the end folded for reclosing the bag. Problems have heretofore been involved in the disposition of the end portions or "tabs" of the reclosure strip means on the bags as supplied by the bag manufacture with regard to shipment to and utilization of the bags by companies packing the bags without modifying their bag packing equipment, and with regard to filled bags in respect to the baling (stacking) of the bags in distribution channels and on the retail shelf.

SUMMARY OF THE INVENTION

Accordingly, among the several objects of the invention may be noted the provision of a bag with an improved reclosure feature comprising a bendable metal reclosing strip means (a "tin tie") wherein the end portions (tabs) of the strip means are so disposed on the bag as to enable baling (stacking) the bags in the usual manner in distribution channels and on the retail shelf, while enabling the ultimate customer readily to manipulate the end tabs for the reclosing of the bag; and the provision of a bag with such strip means which may be applied to the bag in relatively economical manner either by the bag manufacturer or the bag packer on the bag filling line and which, as supplied by the bag manufacturer, enables utilization of the bags generally without modification of the bag packing equipment.

In general, a bag made according to this invention has front and back walls and a closure at one end, being adapted to be opened for removal of its contents at its other end, and means for reclosing the bag at its said other end after opening thereof. The reclosing means comprises substantially inelastic bendable strip means of a total length greater than the width of the walls of the bag bent at two points spaced a distance corresponding generally to the width of the bag walls to have two tab portions at the ends of an intermediate portion thereof. The latter portion has a length corresponding generally to the width of the bag walls. The tab portions are bent back with respect to the intermediate portion and the strip means, so bent, has its said intermediate portion secured to the outside of one of said walls extending across said one wall generally from one side edge of said one wall to the other side edge of said one wall adjacent said other end of the bag with said tab portions extending inwardly from the side edges of said one wall on the outside with respect to said intermediate portion and lying generally flat with respect to the outside face of said one wall. Means secured to said one wall on the outside thereof overlies and covers said folded-back tab portions, said covering means enabling bending out of said tab portions to a position for reclosing the bag after opening thereof by folding the bag over at said end and then bending said tab portions around the side edges of the bag to maintain said end folded.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
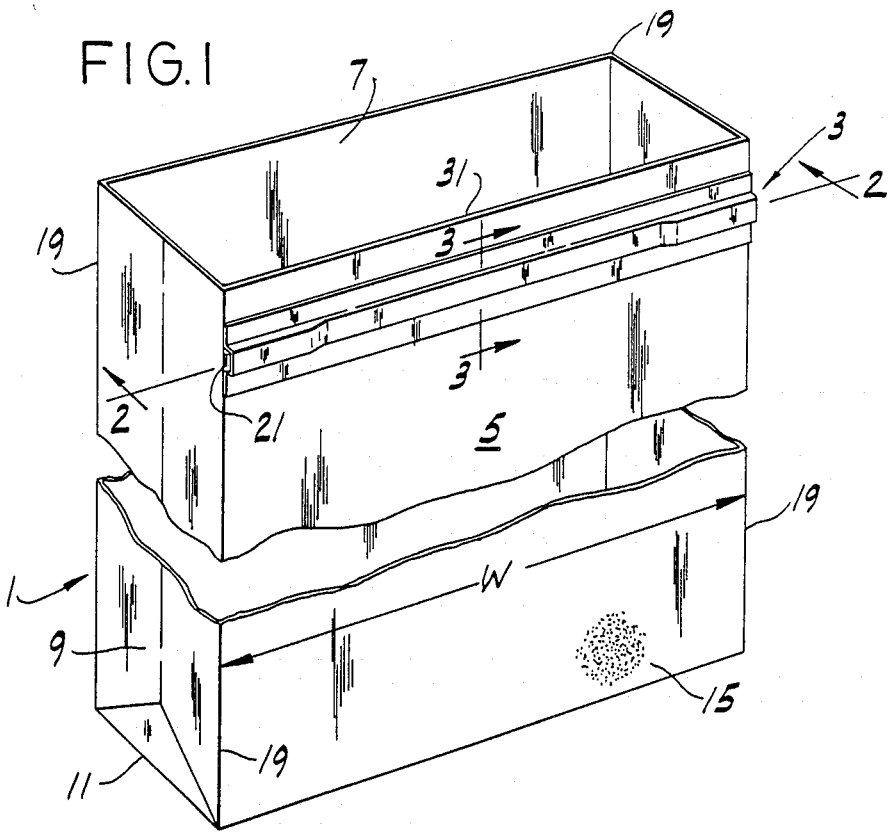
FIG. 1 is a view in perspective of a bag, more particularly a self-opening square bottom ("SOS") bag having a reclosure feature of this invention partly broken way to reduce the height of the view, the bag being shown with its mouth open and with the reclosure feature in its original condition before unfolding of the tab ends of the bendable strip means thereof.
Figure 2:
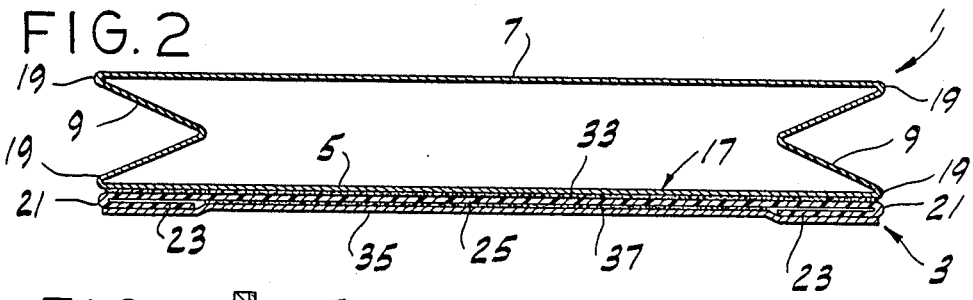
FIGS. 2 and 3 are sections generally on lines 2—2 and 3—3 of FIG. 1, respectively, on a larger scale than FIG. 1 and with thicknesses exaggerated.

Referring first to FIG. 1 of the drawings there is generally indicated at 1 a bag, more particularly a self-opening square bottom ("SOS") paper bag provided with a reclosure feature of this invention as indicated at 3. The bag is generally a gusseted multi-ply paper bag, a showing of the plurality of plies being omitted to avoid unnecessary detail. The bag has front and back walls 5 and 7, side gussets 9 and its square bottom closure is designated 11. The bag is originally made with an open mouth, which is indicated at 13, through which it is filled, and may be closed at the mouth (the top) in any conventional manner, e.g. by sewing, after it has been filled. For certain products, such as pet food, the outer paper ply may be coated on the outside with a thermoplastic coating as indicated at 15 in FIG. 1. It will be understood that the bag 1 may be made in conventional manner.

The reclosure feature of this invention comprises a substantially inelastic bendable strip means indicated generally at 17 in FIGS. 2–6 of a total length greater than the width W of the bag, that is, the width of each of the front and back walls from one side edge 19 thereof to the other. As shown best in FIG. 2, this bendable strip means, which may be referred to as a "tin tie", is bent at two points each designated 21 spaced a distance corresponding to the width W of the bag walls to have two tab portions each designated 23 at the ends of an intermediate portion 25, these tab portions being bent back generally 180° with respect to said intermediate portion and lying flat against the intermediate portion on one side thereof constituting its outside. The intermediate portion 25 has a length corresponding generally to the width W of the bag walls. The intermediate portion 25 is secured at the inside thereof (its side opposite the tabs 23) to the outside of the front wall 5 and extends across that wall generally from one side edge 19 to the other and adjacent the upper end of the bag. The tabs 23 extend inwardly from the side edges 19 and lie generally flat on the outside of the intermediate portion 25 of the strip means and thus lie generally flat with respect to the outside face of the front wall 5 of the bag.

Figure 3:
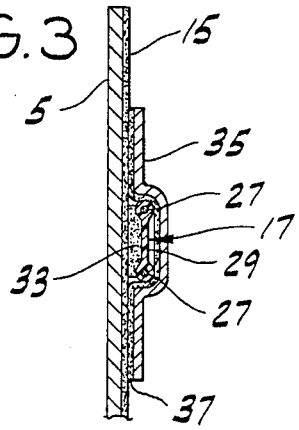

The bendable strip means 17, as shown best in FIG. 3, is a composite comprising a pair of substantially inelastic bendable wires each designated 27 extending parallel to one another and embedded in a strip 29 of plastic material, the wires extending adjacent the edges of the strip of plastic material. The wires may be of any suitable metal adapted when bent to stay bent and the plastic in which the wires are embedded, and held in spaced parallel relation thereby, may be any suitable plastic, such as polyethylene, adapted to be bent and to stay bent with the wires. Such composite wire and plastic "tin ties" are well-known and commercially available. The plastic strip 29 of the intermediate portion 25 of the composite strip means 17 is secured to the outside face of the front wall 5 of the bag extending across this wall generally from one side edge 19 thereof to the other adjacent but spaced from the mouth edge 31 of this wall as by means of a suitable hot melt adhesive as indicated at 33 in FIGS. 2 and 3. The strip means 17 may be about one-quarter inch wide and be spaced down one and one-eighth inch from the top edge of the front wall to the center line of the strip means, for example.

At 35 is indicated means secured to the outside face of the front wall 5 of the bag overlying and covering the strip means 17 including the folded back tabs 23 thereof. This covering means protects the tabs 23, inhibiting inadvertent bending out of the tabs until it is desired to use them for reclosing the bag after it has been opened, and at that time enables bending out of the tabs to a position for reclosing the bag (see FIGS. 4–6) by flattening and folding the bag over at its mouth end and then bending the tabs around the side edges 19 of the bag to maintain said end folded (see FIG. 7). Covering means 35 is constituted by a strip of flexible sheet material, more particularly paper of a length corresponding to the width of the bag and having a coating of heat-sealable material on one face thereof as indicated at 37 by means of which it is heat-sealed to the coated outside face of the front wall 5 of the bag extending across the front wall generally from one side edge 19 thereof to the other overlying the composite strip means 17 (the "tin tie").

Figure 4:
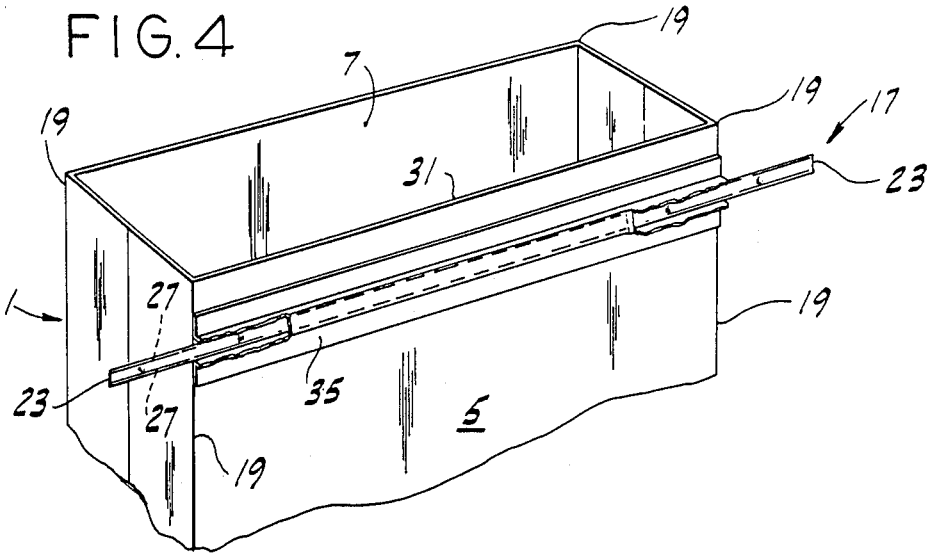
FIG. 4 is a view similar to FIG. 1 showing the tab ends of the bendable metal strip means unfolded.
Figure 5:
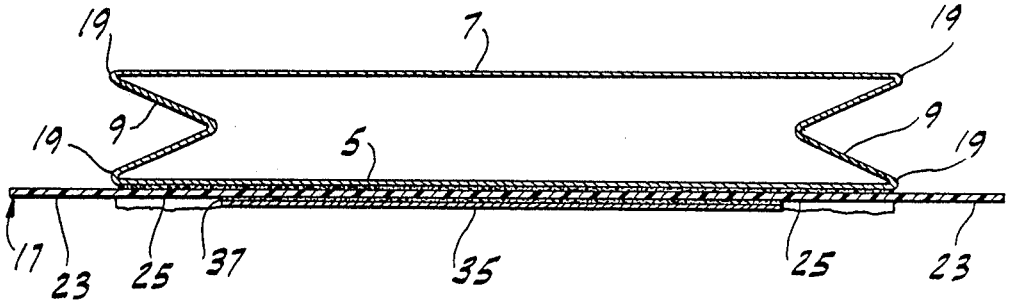
FIG. 5 is a view similar to FIG. 2 showing the tab ends unfolded.
Figure 6:
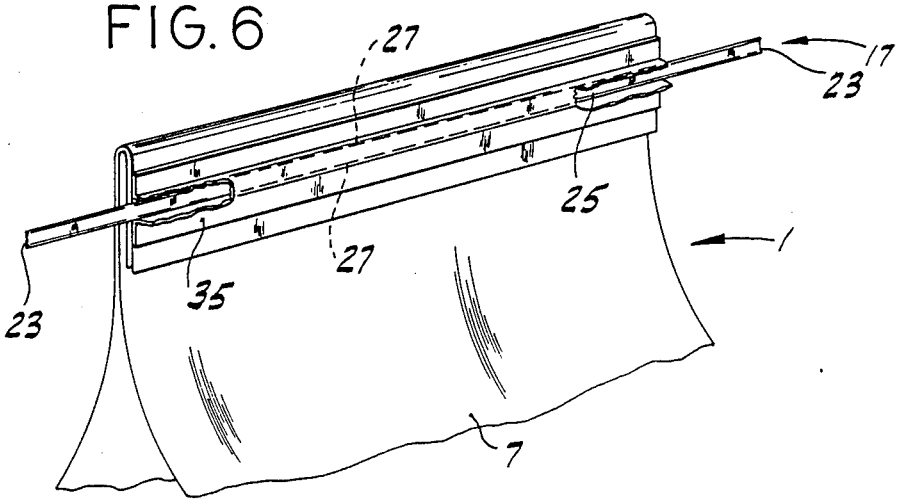
FIG. 6 is a view similar to FIG. 4 but from the opposite face of the bag showing the upper end of the bag folded over for reclosure.
Figure 7:
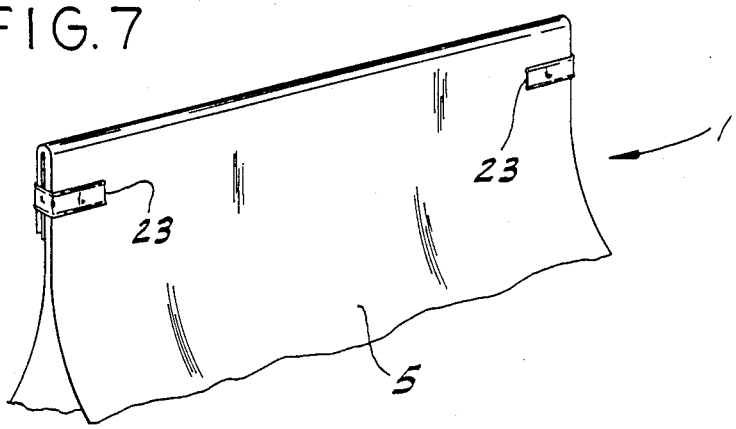
FIG. 7 is a view similar to FIG. 6 but from the other face (i.e., from the same face as FIG. 4) showing the tab ends of the bendable metal strip means folded around the side edges of the bag for maintaining it folded.

It will be observed that with the strip means 17 applied by the bag manufacturer having its end portions or tabs 23 folded back on the outside of its intermediate portion 25 extending inwardly from the side edges 19 of the front wall 5 and covered by the cover strip 35, the bags are capable of being readily stacked flat for shipment by the bag manufacturer to the bag packer, the tabs being protected from being inadvertently bent out. The bags are then readily openable at the bag packer's establishment for being filled and then closed generally without modification of the bag packer's equipment, and are then adapted to go through distribution channels baled in the usual manner and to be stacked on shelves in a retail establishment in the usual manner without trouble from the tabs. When a purchaser has opened the bag and used part of its contents, he may readily reclose the bag by tearing the paper cover strip 35 at the ends of the tabs 23 to obtain access to the tabs, then bending out the tabs to a position such as shown in FIG. 4 as permitted by tearing of the paper strip out to the ends thereof at the side edges 19 of wall 5 along the line of the strip means 17 as the tabs are bent out, then flattening and folding over the bag at its mouth end as shown in FIG. 6, and folding the tabs around the side edges 19 of the bag a shown in FIG. 7 to maintain it folded.

For opening the reclosed bag, the tabs are bent back out to the position of FIG. 5, and may be again used to reclose the bag as often as needed.

Figure 8:
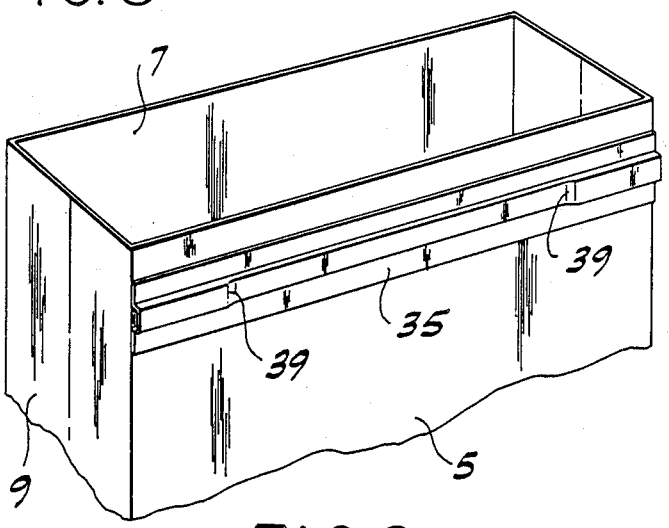
FIG. 8 is a view of the top part of FIG. 1 showing a modification.
Figure 9:
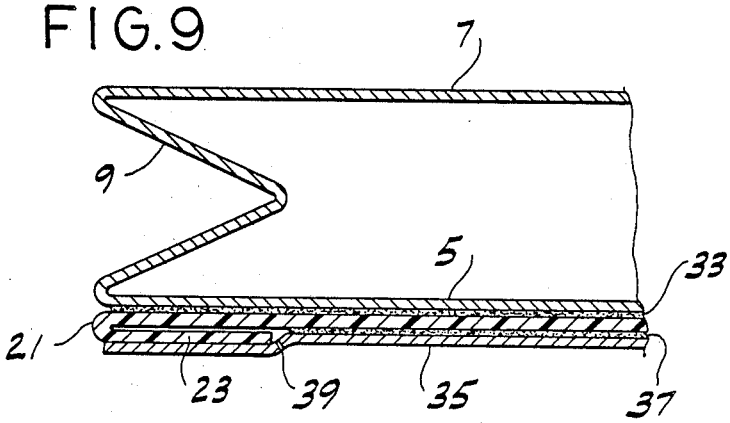
FIG. 9 is a view similar to FIG. 2 enlarged and broken away showing the FIG. 8 modification.

FIGS. 8 and 9 show a modification involving the provision of openings 39 in the form of slits in the cover strip 35 at the ends of the tabs 23 to facilitate access thereto for bending them out.

Figure 10:
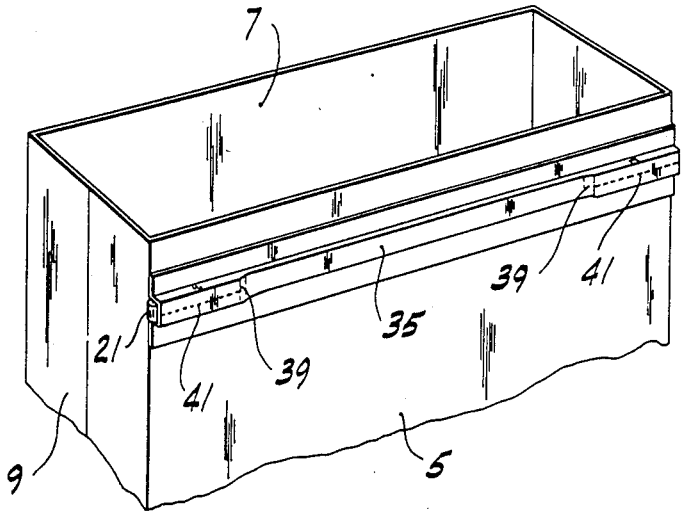
FIG. 10 is a view similar to FIG. 8 showing a further modification.
Figure 11:
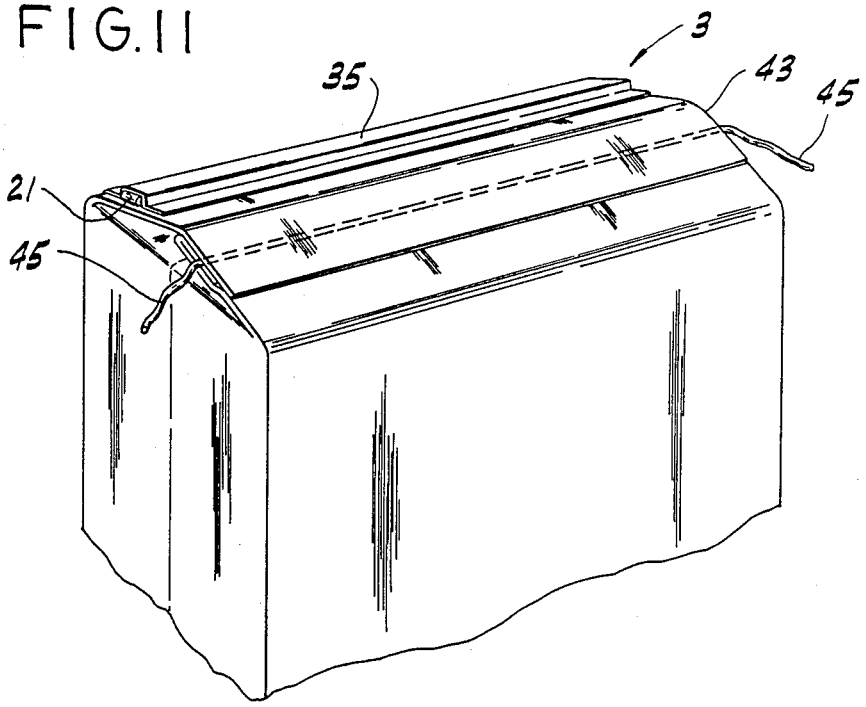
FIG. 11 is a perspective of a bag with pinch bottom and top closures having a reclosure feature of this invention.

FIG. 10 shows a further modification involving the provision of lines of weakness 41, more particularly lines of perforations, along the length of the cover strip 35 over the tabs 23 further to facilitate the bending out of the tabs by making it easier to tear the cover strip 35 out to its ends.

FIG. 10 is a view showing the reclosure feature 3 of this invention applied to a bag having a pinch closure 43 as distinguished from an SOS bag, and it will be understood that this is simply exemplary of other bags to which the invention may be applied. A tear string for opening the pinch closure 43 is indicated at 45. The reclosure feature 3 is applied adjacent this closure.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag having front and back walls and a closure at one end, said bag being adapted to be opened for removal of its contents at its other end, and means for reclosing the bag at its said other end after opening thereof comprising substantially inelastic bendable strip means of a total length greater than the width of the walls of the bag bent at two points spaced a distance corresponding generally to the width of the bag walls to have two tab portions at the ends of an intermediate portion thereof, with said intermediate portion of a length corresponding generally to the width of the bag walls and with said tab portions bent back with respect to said intermediate portion, the strip means so bent having its said intermediate portion secured to the outside of one of said walls extending across said one wall generally from one side edge of said one wall to the other side edge of said one wall adjacent said other end of the bag and with said tab portions extending inwardly from the side edges of said one wall on the outside with respect to said intermediate portion and lying generally flat with respect to the outside face of said one wall, and means secured to said one wall on the outside thereof overlying and covering said folded-back tab portions, said covering means enabling bending out of said tab portions to a position for reclosing the bag after opening thereof by folding the bag over at said end and then bending said tab portions around the side edges of the bag to maintain said end folded.

2. A bag as set forth in claim 1 wherein said covering means comprises a strip of flexible sheet material secured to said one wall extending across said one wall generally from one side edge thereof to the other overlying said strip means.

3. A bag as set forth in claim 2 wherein said covering means comprises a strip of paper sealed to said one wall.

4. A bag as set forth in claim 3 wherein said strip of paper has openings at the ends of said tab portions to facilitate the bending out of said tab portions.

5. A bag as set forth in claim 3 wherein said strip of paper has lines of weakness along its length over said tab portions further to facilitate the bending out of said tab portions.

6. A bag as set forth in claim 1 wherein said bendable strip means comprises at least one substantially inelastic bendable wire embedded in a plastic material.

7. A bag as set forth in claim 1 wherein said bendable strip means comprises a pair of substantially inelastic bendable wires extending parallel to one another and embedded in a strip of plastic material extending adjacent the edges of the strip of plastic material, the strip of plastic material being adhered to said one wall of the bag in said intermediate portion thereof.

8. A paper bag having front and back walls, side gussets, and a self-opening square bottom, and means for reclosing the bag at its top after opening thereof comprising substantially inelastic bendable strip means of a total length greater than the width of bag walls bent at two points spaced a distance corresponding generally to the width of the bag walls to have two tab portions at the ends of an intermediate portion thereof, with said intermediate portion of a length corresponding generally to the width of the bag walls and with said tab portions bent back with respect to said intermediate portion, the strip means so bent having its said intermediate portion secured to the outside of one of said walls extending across said one wall generally from one side edge of said one wall to the other side edge of said one wall adjacent the top of the bag and with said tab portions extending inwardly from the side edges of said one wall on the outside with respect to said intermediate portion and lying generally flat with respect to the outside face of said one wall, and means secured to said one wall on the outside thereof overlying and covering said folded-back tab portions, said covering means enabling bending out of said tab portions to a position for reclosing the bag after opening thereof by folding the bag over at the top and then bending said tab portions around the side edges of the bag to maintain said end folded.

9. A paper bag as set forth in claim 8 wherein said covering means comprises a strip of paper sealed to said one wall extending across said one wall generally from one side edge thereof to the other overlying said strip means.

10. A paper bag having front and back walls and a pinch closure at one end and means for reclosing the bag after it has been opened at said end comprising substantially inelastic bendable strip means of a total length greater than the width of the walls of the bag bent at two points spaced a distance corresponding generally to the width of the bag walls to have two tab portions at the ends of an intermediate portion thereof, with said intermediate portion of a length corresponding generally to the width of the bag walls and with said tab portions bent back with respect to said intermediate portion, the strip means so bent having its said intermediate portion secured to the outside of one of said walls extending across said one wall generally from one side edge of said one wall to the other side edge of said one wall adjacent said end of the bag and with said tab portions extending inwardly from the side edges of said one wall on the outside with respect to said intermediate portion and lying generally flat with respect to the outside face of said one wall, and means secured to said one wall on the outside thereof overlying and covering said folded-back tab portions, said covering means enabling bending out of said tab portions to a position for reclosing the bag after opening thereof at said end by folding the bag over at said end and then bending said tab portions around the side edges of the bag to maintain said end folded.

11. A paper bag as set forth in claim 10 wherein said covering means comprises a strip of paper sealed to said one wall extending across said one wall generally from one side edge thereof to the other overlying said strip means.

* * * * *